US007603853B1

(12) United States Patent
Franco

(10) Patent No.: US 7,603,853 B1
(45) **Date of Patent: *Oct. 20, 2009**

(54) APPARATUS AND METHOD FOR MODELING AND FABRICATING TUBULAR MEMBERS

(76) Inventor: Victor M. Franco, 3996 Hwy. 290 E., Suite C, Dripping Springs, TX (US) 78620

( * ) Notice: Subject to any disclaimer, the term of this patent is extended or adjusted under 35 U.S.C. 154(b) by 169 days.

This patent is subject to a terminal disclaimer.

(21) Appl. No.: 11/586,322

(22) Filed: Oct. 24, 2006

Related U.S. Application Data

(63) Continuation-in-part of application No. 10/863,790, filed on Jun. 8, 2004, now Pat. No. 7,124,575.

(51) Int. Cl.
*F01N 7/10* (2006.01)

(52) U.S. Cl. ..... 60/323; 60/274; 60/313; 60/322; 60/324; 33/23.11; 33/562; 33/565; 138/114; 138/117; 166/77.2; 166/85.1

(58) Field of Classification Search ..... 60/272, 60/274, 282, 312, 313, 314, 322, 323, 324; 33/23.11, 561.1, 562, 565, 566; 425/294, 425/295; 138/114, 115, 116, 117; 166/77.1, 166/77.51, 78.1, 85.1
See application file for complete search history.

(56) References Cited

U.S. PATENT DOCUMENTS 3,889,772 A * 6/1975 Kelley ..... 180/311
4,041,720 A 8/1977 Lebourg
4,593,476 A 6/1986 Clark et al.
4,639,016 A 1/1987 Rogers et al.
4,930,494 A * 6/1990 Takehana et al. ..... 600/145
5,199,258 A 4/1993 Barth
5,423,389 A * 6/1995 Warren et al. ..... 175/75
5,579,639 A 12/1996 Shimoji et al.
5,907,134 A 5/1999 Nording et al.
6,141,958 A 11/2000 Voss
6,741,899 B1 * 5/2004 Wu et al. ..... 700/97
6,742,332 B2 * 6/2004 Piekarski ..... 60/323
6,793,497 B2 * 9/2004 Herman et al. ..... 434/278
6,984,203 B2 * 1/2006 Tartaglia et al. ..... 600/114
7,051,803 B2 * 5/2006 Moretz ..... 166/77.1
7,124,575 B1 * 10/2006 Franco ..... 60/323
7,455,127 B2 * 11/2008 Schick ..... 175/61

* cited by examiner

*Primary Examiner*—Binh Q Tran
(74) *Attorney, Agent, or Firm*—Kenneth A. Roddy

(57) ABSTRACT

A plurality of interchangeable straight and curved short cylindrical module segments are selectively and releasably joined together end-to-end manually and rotated relative to one another to form full-scale three-dimensional models of desired complex shapes of tubing, pipe, and conduit configurations. The segments are provided in sets having outside diameters corresponding to the outside diameters of conventional tubing, pipe or conduit and have a circumferential scale at each end to visually determine the relative rotation between one segment and an adjoined segment. When assembled, the model provides accurate shapes and dimensions to aid in designing, laying out, cutting, and fabricating tubular members, and for forming tubular configurations from pre-bent metal tubular sections and the proper relative rotation between them.

1 Claim, 2 Drawing Sheets

APPARATUS AND METHOD FOR MODELING AND FABRICATING TUBULAR MEMBERS

CROSS REFERENCE TO RELATED APPLICATION

This application is a continuation-in-part of U.S. patent application Ser. No. 10/863,790, filed Jun. 8, 2004, now U.S. Pat. No. 7,124,575, the entirety of which is incorporated herein by reference.

BACKGROUND OF THE INVENTION

1. Field of the Invention

This invention relates generally to apparatus and methods used in the design and manufacturing of tubular products and, more particularly, a modular modeling apparatus and method for designing and manufacturing complex shapes of tubing, pipe, and conduit.

2. Background Art

In many industries, it is difficult and time consuming to design, layout, and fabricate complex shapes of tubing, pipe, and conduit, such as for example, refinery piping layouts, piping layouts in ships and submarines, and in civil engineering applications, to name a few.

In the automotive industry high performance and racing internal combustion engines require the design, manufacturing and fabrication of complex exhaust systems, more particularly the tubular exhaust headers, which are custom-made exhaust manifolds of equal length constructed of welded sections of straight and bent metal tubing whose purpose is to achieve higher power output by maximizing the evacuation and scavenging of the exhaust gases out of each individual cylinder of the internal combustion engine. Maximum performance is accomplished through the precise and optimized dimensioning of the individual tubing sections, known as the primary runners, such as the overall length of the pipes, their outside diameter and the wall thickness, among others. These dimensions are critical to meet the specific performance and power requirements set for the particular engine design, and the intended application or applications.

The construction of complex shapes of tubing, pipe, and conduit, pose a significant challenge to the designer and fabricator. Since the location of the endpoints of the tubular configuration may be set and fixed, exploring the numerous possible shapes and pathways between such endpoints can become an overwhelming, time consuming and expensive task. Typically the designer needs to find the optimum layout for tubular member, which also has to fit precisely in the available space, and will often employ models or prototypes using cut sections of pre-bent tubing and welding them together.

Many prior art methods exist that attempt to find the best pipe routing to fit in the available space. A typical method is to approximate the pathway of the tubing, pipe, or conduit using flexible tubing as a model. Then, the resulting shape is divided into sections than can be obtained from existing pre-bent metal tubing. However, this method is inaccurate because it relies entirely on the precision of manually bending the flexible tubing multiple times (which tends to naturally spring back), to simulate the curves of the actual metal tubing. Imprecision in the bending of the model by hand will render the metal prototype useless as soon as the first mismatch is encountered during the process of welding the actual metal tubing sections.

Another prior art method is to utilize wire to create the ideal centerline of the pathways. This approach not only carries the inaccuracies of the previous method, but also fails to take into consideration the interference that will very likely occur by omitting the volume occupied by the tubing, pipe, or conduit members themselves. This situation may result in layouts that are impossible to build.

There are several patents directed toward complex and expensive tube bending fixtures and jigs and apparatus for aligning sections of tubing, pipe, and conduit.

Clark et al, U.S. Pat. No. 4,593,476 discloses a computer aided adjustable tube checking fixture system made up of a template placed on a flat metallic surface, and a series of adjustable holding fixtures places at selected positions along the template. The template has a computer aided layout of a plan view of a formed tube inscribed on a film with selected check points along the layout showing the height and angle of the tubing above the check point. Each holding fixture is adjustable as to height and angle, is indexed to align to the check point, and has a switchable on-off magnet in the base to secure the fixture in position.

Rogers et al, U.S. Pat. No. 4,639,016 discloses a system for repairing pipeline, such as underground fuel, gas or water pipeline systems, which have been damaged by explosives, wherein the ruptured sections have been misaligned. Quick-connect fittings are attached to the misaligned pipe ends after trimming and a bridging conduit system is interposed between the fittings having adjustable portions for accommodating the misalignment. Rotative angular sections provide universal adjustment while retaining the fluid-tight integrity of the apparatus.

Lebourg, U.S. Pat. No. 4,041,720 discloses a method and apparatus for installing a spool between misaligned underwater pipeline sections to effect connection thereof, which is based upon the precise determination of the spatial relation between the pipe ends and the determination of an angle of entry of the spool in a direction to avoid binding between the pipe and spool ends.

The present invention provides a solution that offers the designer a simple way to safely and inexpensively build and modify full-scale 3D models as many times as required before any metal cutting or welding takes place. It also yields the exact dimensions to cut each of the required pre-bent metal tubing, pipe or conduit sections, and the relative rotation between them when the approved prototype is finally welded together.

The present invention is distinguished over the prior art in general, and these patents in particular by a modeling apparatus that includes a plurality of interchangeable straight and curved short cylindrical segment members which are selectively and releasably joined together end-to-end manually and rotated relative to one another to form a full-scale three-dimensional model of desired complex shapes of tubing, pipe, and conduit configurations. The segments are provided in sets having outside diameters corresponding to the outside diameters of conventional tubing, pipe or conduit and have a circumferential scale at each end to visually determine the relative rotation between one segment and an adjoined segment. When assembled, the model provides accurate shapes and dimensions to aid in designing, laying out, cutting, and fabricating tubular members, and for forming tubular configurations from pre-bent metal tubular sections. It also displays the proper relative rotation between the sections.

SUMMARY OF THE INVENTION

It is therefore an object of the present invention to provide a modeling apparatus and method for designing and manufacturing complex shapes of tubing, pipe, and conduit.

It is another object of this invention to provide a modeling apparatus and method for designing and manufacturing complex shapes of tubing, pipe, and conduit that allows a person to design and safely and inexpensively build and modify full-scale three-dimensional models of desired tubular configurations as many times as required before any metal cutting or welding takes place.

Another object of this invention is to provide a modeling apparatus and method for designing and manufacturing complex configurations of tubing, pipe, and conduit that will permit optimum layout and pathways that accurately fit within an available space.

Another object of this invention is to provide a modeling apparatus and method for designing and manufacturing complex configurations of tubing, pipe, and conduit that will allow precise and optimized dimensioning of all aspects of the tubular sections to meet specific performance and space requirements.

A further object of this invention is to provide a modeling apparatus and method for designing and manufacturing complex configurations of tubing, pipe, and conduit assemblies that yields the exact dimensions to cut and form sections of a desired configuration from pre-bent metal tubing sections, and the relative rotation between them.

A still further object of this invention is to provide a modeling apparatus that is simple in construction, inexpensive to manufacture and reliable and accurate in operation.

Other objects of the invention will become apparent from time to time throughout the specification and claims as hereinafter related.

The above noted objects and other objects of the invention are accomplished by a modeling apparatus that includes a plurality of interchangeable straight and curved short cylindrical segment members which are selectively and releasably joined together end-to-end manually and rotated relative to one another to form a full-scale three-dimensional model of desired complex shapes of tubing, pipe, and conduit configurations. The segments are provided in sets having outside diameters corresponding to the outside diameters of conventional tubing, pipe or conduit and have a circumferential scale at each end to visually determine the relative rotation between one segment and an adjoined segment. When assembled, the model provides accurate shapes and dimensions to aid in designing, laying out, cutting, and fabricating tubular members, and for forming tubular configurations from pre-bent metal tubular sections. It also displays the proper relative rotation between the sections.

DESCRIPTION OF THE PREFERRED EMBODIMENT

The present modeling apparatus includes a plurality of interchangeable straight and curved short cylindrical members or segments which may be selectively and releasably joined together end-to-end and rotated relative to one another to form a full-scale three-dimensional model of a desired complex tubular configuration and optimum layout and pathways that accurately fit within an available space. The modeling apparatus also provides accurate dimensions to aid in cutting and forming sections of the tubular configuration from pre-bent metal tubing sections, and additionally indicates the proper relative rotation between the sections. The straight and curved short cylindrical members or segments are provided in sets having outside diameters corresponding to the outside diameters of conventional metal tubing, pipe or conduit typically used in the particular industry in which the fabricated tubular member is to be employed.

In the following discussion, for purposes of example only and not limited thereto, the apparatus and method are described for fabricating exhaust headers for a combustion engine, and the particular sizes and dimensions recited are typically used in that industry. However, it should be understood that the apparatus and method may be used in a wide variety of industries and the particular sizes and dimensions of the segments and the metal tubing, pipe or conduit may vary corresponding to those typically used in the particular industry in which the fabricated tubular member is to be employed.

Figure 1:
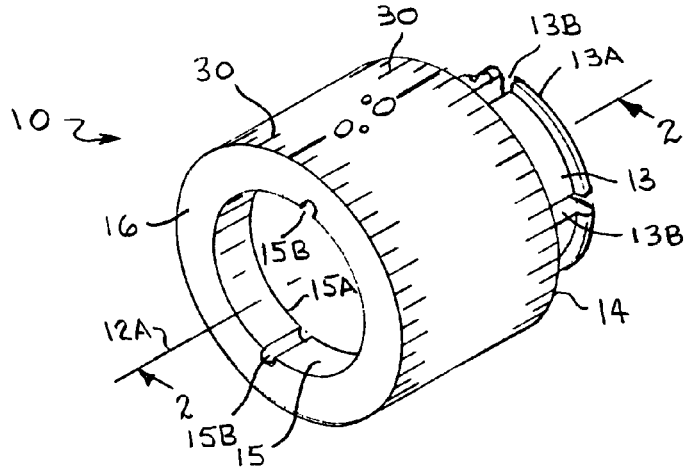
FIG. 1 is an isometric view of a straight segment member of the present modeling apparatus in accordance with the present invention.
Figure 2:
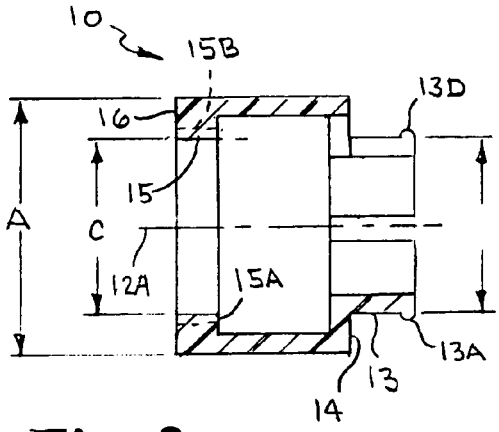
FIG. 2 is a longitudinal cross section of the straight segment member taken along line 2-2 of FIG. 1.

FIGS. 1 and 2 show a typical straight cylindrical member or segment 10 having a larger outside diameter 11 of a size "A" extending along a straight longitudinal center axis 12A, a reduced diameter cylindrical neck portion 13 of a size "B" at one end defining a surrounding flat radial shoulder 14, and a reduced diameter cylindrical socket 15 of a size "C" extending inwardly a short distance from the outer face 16 of the opposed end. In a preferred embodiment of the straight cylindrical segments 10, the distance between the outer face 16 and the flat radial shoulder 14 is about 1.00" in length.

The size "A" of the outside diameter 11 preferably corresponds to the outside diameter of conventional metal tubing, pipe or conduit typically used in the particular industry in which the fabricated tubular member is to be employed. For example, in the construction of exhaust headers, the size "A" of the outside diameter 11 may be 1.500" or 1.750", but may vary depending upon the particular industry in which the fabricated tubular member is to be employed.

The reduced diameter "C" of the cylindrical socket 15 is sized to receive the diameter "B" of the neck portion 13 of another straight or curved segment, for example, the inside diameter "C" of the cylindrical socket 15 may be 0.005" larger in diameter than the outside diameter "B" of the neck portion 13 to provide a snug fit but still allow relative rotation between the segments.

Figure 3:
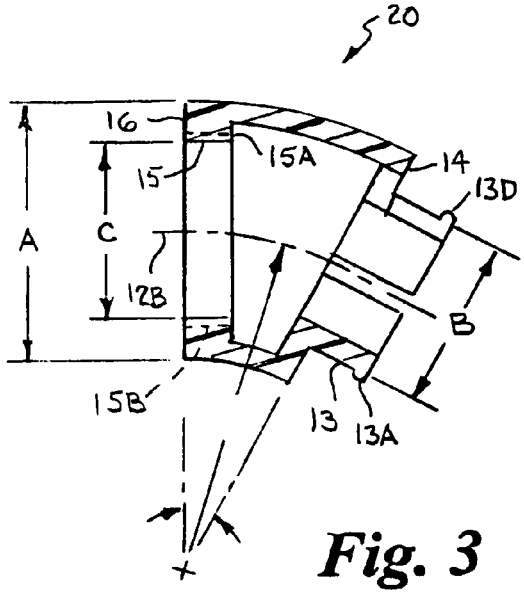
FIG. 3 is a longitudinal cross section of a curved segment member of the modeling apparatus in accordance with the present invention.

FIG. 3 shows a typical curved cylindrical member or segment 20 having a larger outside diameter 11 of a size "A" extending along a curved longitudinal center axis 12B, a reduced diameter cylindrical neck portion 13 of a size "B" at one end defining a surrounding flat radial shoulder 14, and a reduced diameter cylindrical socket 15 of a size "C" extending inwardly a short distance from the outer face 16 of the opposed end. As described above, the inside diameter "C" of the cylindrical socket 15 is sized to receive the outside diameter "B" of the neck portion 13 of another straight or curved segment and allow relative rotation between the segments. The size "A" of the outside diameter 11 preferably corresponds to the outside diameter of conventional metal tubing, pipe or conduit typically used in the particular industry in which the fabricated tubular member is to be employed. For example, in the construction of exhaust headers, the size "A" of the outside diameter 11 may be 1.500" or 1.750", but may vary depending upon the particular industry in which the fabricated tubular member is to be employed.

The curved longitudinal center axis 12B of the curved cylindrical segments 20 are provided in a plurality of different radiuses of curvature, typically those of conventional metal tubing, pipe or conduit typically used in the particular industry in which the fabricated tubular member is to be employed. For example, as shown in Table 1 below, in the construction of exhaust headers, the curved cylindrical segments 20 of 1.500" or 1,750" O.D. may be provided with radiuses ranging from a 2.00" radius "D" that extends through an included angle "E" of 28.64° between the outer face 16 and the flat radial shoulder 14, to a 6.00" radius that extends through an included angle of 9.54° between the outer face 16 and the flat radial shoulder 14 so that the overall arc length at the centerline or axis 12B is about 1.00".

TABLE 1

| DIMENSIONS FOR SEGMENTS IN INCHES | | | | | | |
|---|---|---|---|---|---|---|
| O.D. "A" | 1.500" or 1.750", etc. | | | | | |
| O.D. "B" | 1.000" | | | | | |
| I.D. "C" | 1.005" | | | | | |
| | Straight | Curved | Curved | Curved | Curved | Curved |
| RADIUS "D" | 0 | 2.000" | 2.500" | 3.000" | 4.000" | 6.000" |
| ANGLE "E" | 0 | 28.64° | 22.91° | 19.10° | 14.32° | 9.54° |

In a preferred embodiment, the straight and curved segments 10 and 20 are formed of plastic and are of hollow construction having an axially extending generally cylindrical open interior to make the segments and assembly formed thereby as light as possible, although the straight and curved segments may be of solid construction.

Each of the straight and curved cylindrical segments 10 and 20 is provided with a circumferential scale 30 at each end of its larger outside diameter to visually determine the relative rotation between one segment and an adjoined segment. A suitable scale 30 has thirty-six marks or notches circumferentially spaced 10° apart with a 0° mark or notch represented by a dot or other indicia placed consistently in the same location in all segments as a reference point. Thus, the scale 30 visually indicates the angular rotation of one segment relative to an adjoined segment in a full 360° rotational range.

Figure 4:
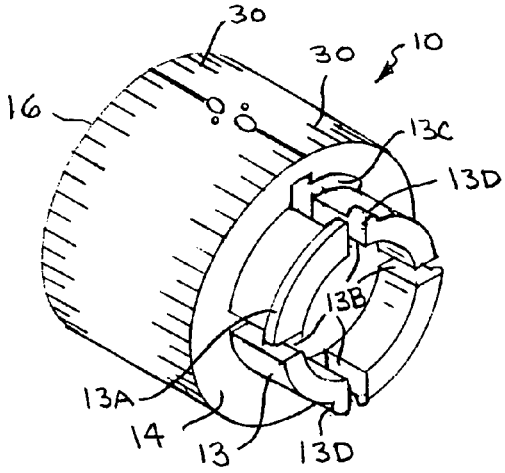
FIG. 4 is an isometric view of a straight segment member, showing the snap fit connection on the neck portion.

As best seen in FIGS. 1 and 4, in a preferred embodiment, the connection at each end of the straight and curved segments 10 and 20 is a male and female "snap fit" type releasable connection. A straight segment 10 is shown for purposes of example. The neck portion 13 is provided with a circumferential raised bead 13A at its outer end and is segmented into arcuate segments by circumferentially spaced longitudinal slots 13B. A diametrically opposed pair of the arcuate segments may be provided with a short radial slot 13C at the intersection of the neck portion 13 and the flat radial shoulder 14 to facilitate flexibility. A small raised protuberance or bump 13D may be formed on the diametrically opposed pair of the arcuate segments. As seen in FIG. 1, the cylindrical socket 15 is provided with a flat interior radial shoulder 15A having a pair of diametrically opposed small longitudinal recesses 15B to receive the bumps 13D of the neck portion 13. When the neck portion 13 of one segment is pressed into the socket portion 15 of another segment, the bead 13A on the neck portion is engaged on the radial shoulder 15A in a "snap fit" arrangement that allows relative rotation.

As described below, the user can make an accurate full-scale three-dimensional model of a desired complex tubular configuration utilizing the modeling segments by selecting the straight and curved segments 10, 20, of the proper outside diameter and manually joining them together end-to-end and rotating them relative to one another to achieve the length, configuration, optimum layout and pathway for each tubular configuration to fit within an available space and around existing obstructions.

The following is a description of the steps the user would typically take in order to complete the complex tubular configuration, utilizing an engine exhaust header as an example of the complex tubular configuration.

Figure 5:
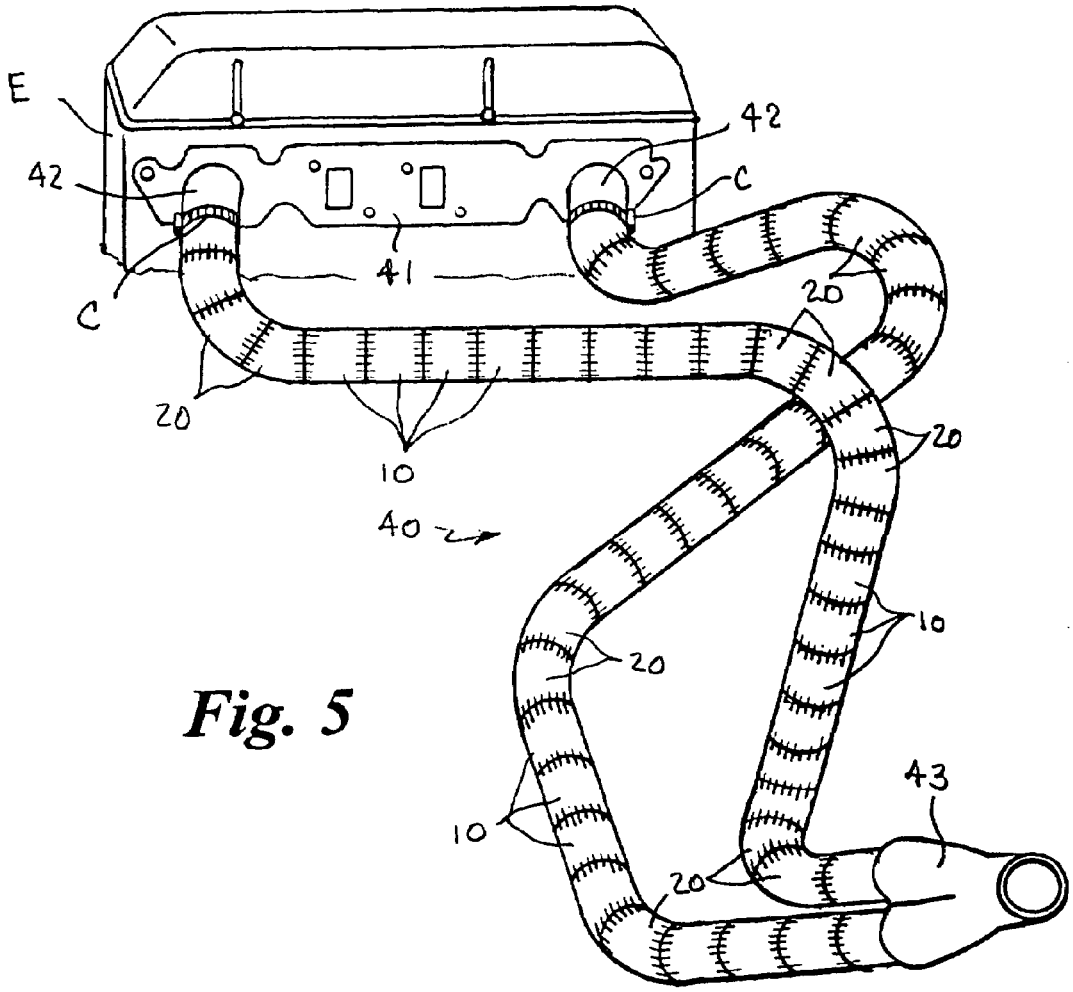
FIG. 5 is a perspective view showing a plurality of the straight and curved segments assembled to form a three-dimensional a model of an engine exhaust header.

As shown in FIG. 5, the user can make an accurate full-scale three-dimensional model 40 of a desired engine exhaust header configuration utilizing the modeling segments by selecting the straight and curved segments 10, 20, of the proper outside diameter and manually joining them together end-to-end and rotating them relative to one another to achieve the desired runner length, configuration, optimum layout and pathway for each primary pipe to fit within the available space in and around the engine compartment and existing obstructions. The following is a description of the steps the user would typically take in order to complete the design.

(1) With the exhaust header metal flange 41 and its starter tubes 42 mounted on the engine E, and the primary pipes collector 43 already fixed in their desired locations in the vehicle or along the exhaust system, the starting and end points for the header model become set.

(2) The total required length of each of the runners for the exhaust header design or configuration to be built is determined. This length, in whole inches will indicate the quantity of segment members to use per runner. Typically this length ranges from 15 to 35 inches per runner (or cylinder) for automotive engines.

(3) Utilizing conventional hose clamps C, the user firmly fixes the first header model straight or curved segment to the metal starter tube 42 for each runner.

(4) Beginning with the most challenging runner, the user then begins connecting additional segments and orienting them to build the pathway for each runner one at a time and all the way to its endpoint at the exhaust collector 43. This stage may require an amount of repetition, since it is likely that as the model becomes more complex and more runners are added, more frequent adjustments will be required to clear any obvious interference. Ideally, curves of the largest radiuses are preferred as much as the design allows.

(5) Once the model is completed to the user's satisfaction, the number and type of segments required for each runner and the relative rotation is tallied and recorded. This information will indicate the number of segments, thus, the linear length in metal tubing required to reproduce the section of each of the runners. It will also indicate the relative rotation between one section and the next by keeping, track of the radial marks between the zero index of one segment and the adjoining one.

(6) The user then cuts metal tubing sections corresponding to the configuration of the segments from pre-bent metal tubing and begins to replace them in the actual model assembly by tack-welding the first metal sections to the exhaust flange starter tubes 42.

(7) One at a time, additional sections of metal tubing will be added until the actual metal tubing runner is formed.

(8) Finally, the entire runner is welded completely and secured to the exhaust flange on one end and at the exhaust collector at the other.

Thus, the assembled model provides the user with the required length, the bend angles and angles of rotation at known incremental lengths along the length of the assembly for each runner to reproduce the corresponding metal tubing runners.

Because the mating connections 13, 15, at each end of the segments is the same size for the various different outside diameters, the present modeling apparatus also allows the user to combine straight and curved segments of different outside diameters to accurately build complex tubular configurations having "stepped" diameters of different size in the same tubular member.

For example, the user can combine straight and curved segments of different outside diameters to forming an exhaust header known in the industry as a "stepped header". Where the "conventional" header consists of bent tubes of a single diameter that extend from the header flange to the collector, the "stepped" header has header tubes that are formed of at least two different diameters of tubing. Typically, the smaller tubing diameter emerges from the header flange port and, at some distance from the header flange, larger diameter tubing is slipped over and welded to the smaller diameter tubing. The location of change in tubing diameter is called a "step" (usually, a "step" UP in diameter). The stepped header arrangement aids in the scavenging of exhaust gases, particularly at very high engine speeds.

Although a preferred method of constructing the header from metal tubing has been described, it should be understood, that in some cases the assembled model may be removed intact and a length of metal tubing may be placed against, or adjacent to, the assembled model and bent as necessary to achieve the configuration of the model.

It should be understood that the exhaust header is used for purposes of example only and that the present invention is not limited thereto, and that the apparatus and method described herein may be employed in a wide variety of industries and the particular sizes and dimensions of the segments and the metal tubing, pipe or conduit may vary corresponding to those typically used in the particular industry in which the fabricated tubular member is to be employed.

While this invention has been described fully and completely with special emphasis upon preferred embodiments, it should be understood that within the scope of the appended claims the invention may be practiced otherwise than as specifically described herein.

The invention claimed is:

1. A modeling apparatus for aiding in the design and construction of complex tubular configurations, comprising:

a plurality of interchangeable short straight cylindrical segment members and curved cylindrical segment members, each having an outside diameter of a size corresponding to a known outside diameter of a conventional tubular member, a first end and a second end, and connector means at said first end and at said second end for releasably connecting together said first end of one of said segments to said second end of another one of said segments in end-to-end relation and allowing relative rotation therebetween;

said connector means at said first end comprising an outwardly extending cylindrical neck portion with a circumferential raised bead at its outer end, and segmented into arcuate segments, and said connector means at said second end comprising a cylindrical cavity surrounded by a radial shoulder sized to receive said arcuate segments and engage said circumferential raised bead when said neck portion of one segment member is pressed into said cylindrical cavity of another segment member in a snap fit relation that allows relative rotation; and circumferential scale means at each end of said outer diameter for visually indicating the relative rotation between each of said segments when connected together;

said outside diameter of said straight cylindrical segments extending along a straight longitudinal center axis, and said outside diameter of said curved cylindrical segments extending along a curved longitudinal center axis;

selected said straight and curved segments being releasably connected together end-to-end and manually rotated relative to one another to form a full-scale three-dimensional model of a desired tubular configuration which is used as a template for forming and constructing a tubular configuration from metal tubing, pipe or conduit.

* * * * *